United States Patent [19]

Bayly et al.

[11] 4,273,493

[45] Jun. 16, 1981

[54] ROTARY FURNACE VOLUMETRIC FEEDER WITH SEALED CHUTE

[75] Inventors: William I. Bayly, Livingston; Louis J. Rumbolo, Toms River; Ernest E. Fazekas; Frank Korzeb, both of Westfield, all of N.J.

[73] Assignee: American Gas Furnace Company, Elizabeth, N.J.

[21] Appl. No.: 968,579

[22] Filed: Dec. 11, 1978

[51] Int. Cl.[3] ..... F27B 7/32

[52] U.S. Cl. ..... 414/221; 432/117; 414/149; 414/219

[58] Field of Search ..... 414/149, 219, 217, 221; 432/117, 242; 34/242; 65/335

[56] References Cited

U.S. PATENT DOCUMENTS

| | | | |
|---|---|---|---|
| 3,280,993 | 10/1966 | Wolfe | 414/149 |
| 3,554,114 | 1/1971 | McPhail | 414/221 X |
| 3,836,324 | 9/1974 | Shaefer | 432/117 X |
| 3,878,947 | 4/1975 | Bayly | 414/149 |
| 4,089,429 | 5/1978 | Stock et al. | 414/221 X |
| 4,140,228 | 2/1979 | Hathaway et al. | 414/221 X |

FOREIGN PATENT DOCUMENTS

| | | | |
|---|---|---|---|
| 329558 | 11/1920 | Fed. Rep. of Germany | 432/117 |

*Primary Examiner*—Leslie J. Paperner
*Assistant Examiner*—Terrance L. Siemens
*Attorney, Agent, or Firm*—Lerner, David, Littenberg & Samuel

[57] ABSTRACT

A rotary furnace volumetric feeder includes a hopper for receiving work pieces, a feed chute which includes two openings disposed therein, a measuring station and discharge chute. The discharge chute is normally sealed, thereby precluding the outside atmosphere from entering the furnace while permitting oven gases to slowly leak to the outside atmosphere providing a more controlled atmosphere in the oven yielding a more controllable process and an improved product.

5 Claims, 2 Drawing Figures

ROTARY FURNACE VOLUMETRIC FEEDER WITH SEALED CHUTE

BACKGROUND OF THE INVENTION

1. Field of the Invention

This invention relates to volumetric feeders, and more specifically, to a volumetric feeder for a rotary furnace.

2. Description of the Prior Art

Prior art rotary retort furnaces are faced with the problem of feeding metal parts therein without either damaging the metal parts or allowing too much outside atmosphere to enter. A typical solution to this problem is disclosed in the patent issued to Charles W. Wolfe, U.S. Pat. No. 3,280,993. A spiral loading chute which feeds metal parts into the retort furnace at a predetermined rate is disclosed therein. A gate mounted in the spiral chute selectively passes materials therethrough while it seals off the furnace from the outside air.

One major difficulty with this approach is that the batch delivered to the furnace is frequently of an irregular volume. This is a problem because the metal parts act like a heat sink and unless they are evenly loaded into the spiral retort uneven temperature distribution may result causing the quality of the output product to vary.

Another solution to the problem is disclosed in the patent to William I. Bayly, U.S. Pat. No. 3,878,947. The disclosure therein overcomes some prior art shortcomings by providing a measuring station where the amount of work pieces may be measured prior to being fed into the furnace. However, since a single door is used to permit the work pieces to enter the furnace, the outside atmospheric air is permitted to enter the furnace therewith, thereby varying the concentration of the oven gases and the temperature causing an inferior product to be produced.

SUMMARY OF THE INVENTION

The present invention overcomes the shortcomings found in the prior art by providing a means whereby a measured pre-determined amount of work pieces may enter the furnace with a minimum of outside atmospheric air, thereby precluding contamination of the furnace gases or erratic changes in the temperature therein.

In a volumetric feeder for rotary furnaces having a hopper for receiving work pieces, a feed chute, a measuring station and a discharge means, according to the principles of the present invention, comprises first gate means disposed at one end of the chute means proximate the measuring station. The first gate means is timed to open and receive the work pieces at a particular point in the rotary cycle. A second gate means is disposed at the other end of the chute means proximate the discharge means. The second gate means opens at another time in the rotary cycle, which occurs after the first gate means opening, and discharges by gravity the measured quantity of work pieces into the discharge means which communicates with the mouth of the furnace.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
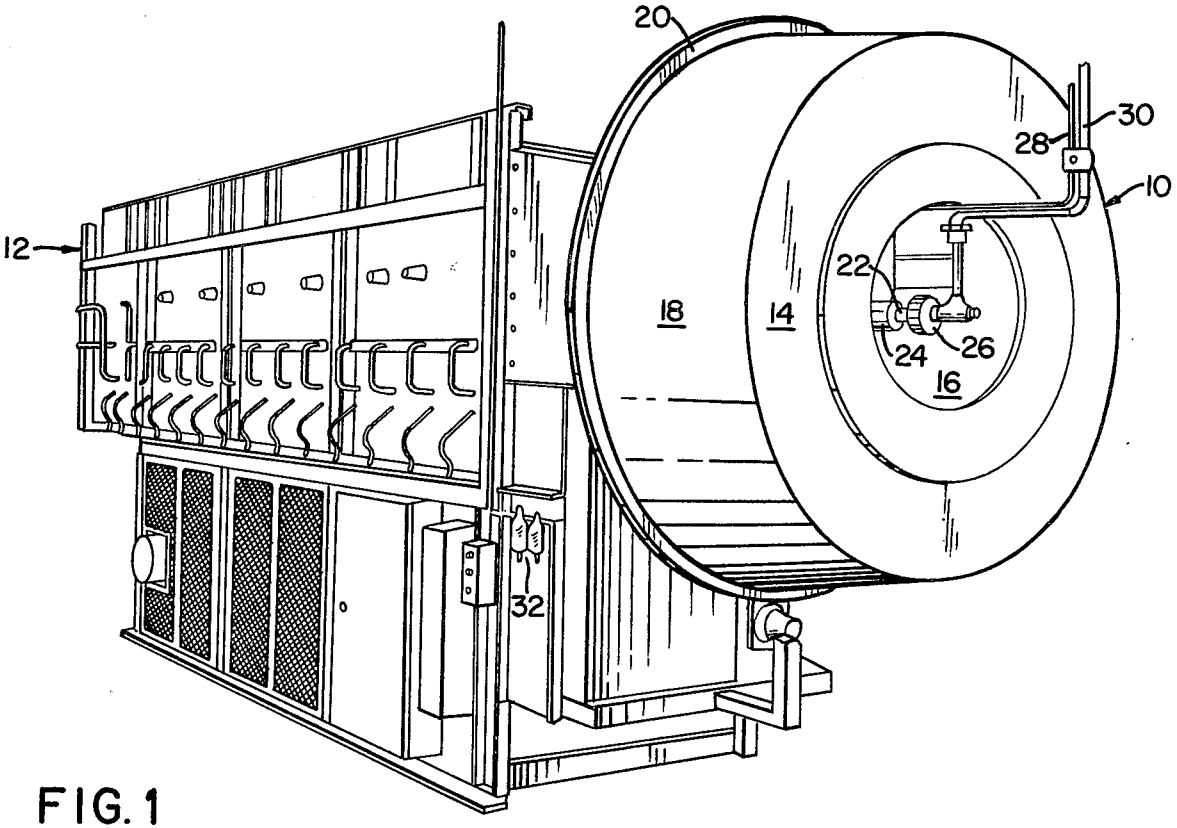
FIG. 1 is a perspective view of a volumetric feeder as used in a conventional rotary furnace.

Referring now to the figures, and in particular to FIG. 1, which discloses a volumetric feeder 10 of the present invention, shown in place on a conventional spiral rotary furnace 12. The visible elements of the rotary furnace volumetric feeder 10 include a front portion 14 which includes an aperture or charging opening 16 therein, a tapered sidewall section 18 and a rear plate section 20, the rim of which is just visible. Projecting through opening 16 is a centrally located pipe 22. Connected to pipe 22 are a pair of rotary fittings 24 and 26 which communicate, respectively, with air cylinder supply line 28 and atmosphere inlet tubing 30. Air pressure regulating and filtering apparatus is shown generally as element 32 and is connected to the stationary portion of the rotary furnace 12. Air pressure is supplied selectively to line 28 by a limit switch valve mechanism and cam, not shown, attached to the back of plate 20. The feeder thus far described is therefore similar in outward appearance to the spiral loading chute apparatus described in U.S. Pat. Nos. 3,280,993 and 3,878,947. U.S. Pat. No. 3,878,947, issued to William I. Bayly on Apr. 22, 1975, is incorporated herein in its entirety. The improvement over this prior art will be more fully appreciated with reference to FIG. 2 herein.

Figure 2:
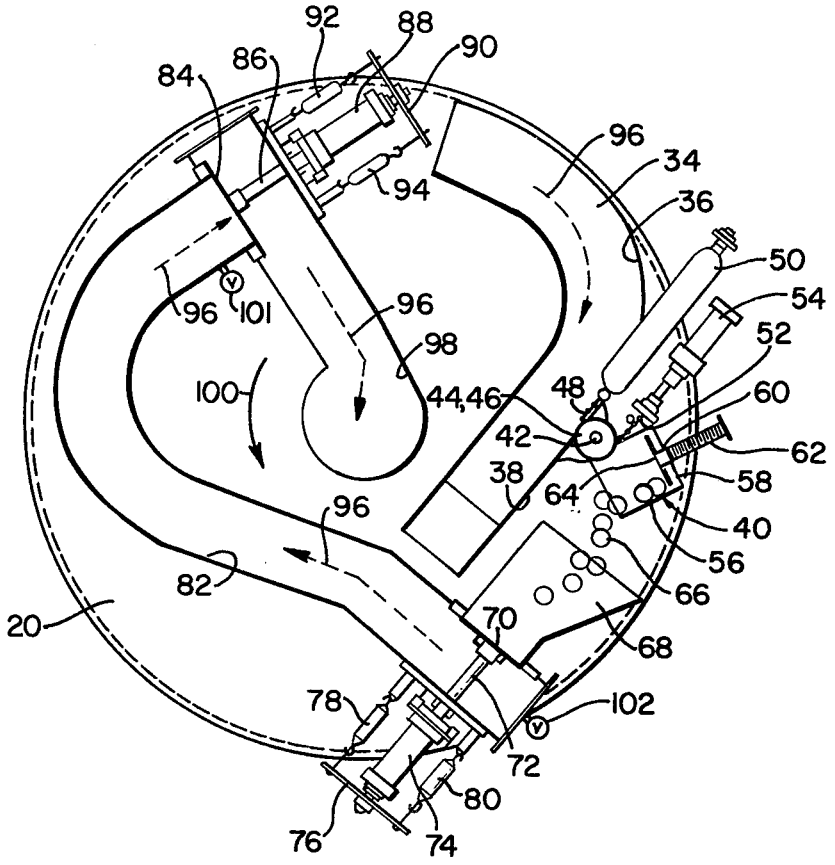
FIG. 2 is an elevational view of the volumetric feeder of the present invention as seen from the rear.

FIG. 2 discloses the rear view of a rear plate section 20 which yields improved performance. Rear plate 20 includes a J-shaped opening 34 which communicates directly with feed chute 36. More precisely the area directly under opening 34 comprises the feed chute 36, which is the same as that disclosed in U.S. Pat. No. 3,878,947. Feed chute 36 is provided with an opening 38 at one end thereof, which communicates with the measuring station 40. The measuring station 40 is hingedly affixed to the feed chute 36 by means of a shaft 42 which has affixed thereon a pair of sprockets 44 and 46. Sprocket 44 is connected, via a chain 48, to tension spring 50. Sprocket 46 is connected, via chain 52, to air cylinder 54.

Measuring station 40 preferably includes a cylindrically-shaped housing 56 having a bottom portion 58 provided with a centrally disposed threaded aperture 60 adapted to receive threaded shaft 62 therein. Shaft 62 is affixed to a plunger 64 disposed within the housing 56. By rotating threaded shaft 62 in aperture 60, the plunger maybe used to enlarge or reduce the measuring volume available to receive batches of work pieces 66 falling therein. Spring 50 normally urges sprocket 44 in such a direction to maintain the housing 56 in intimate contact with the feed chute 36 thereby keeping opening 38 covered.

Measuring station 40 when activated to the dump position, as shown in FIG. 2, by the activation of air cylinder 54 permits the work pieces 66 to flow into a receiving chute 68, the bottom portion of which is kept normally closed by a gate means or door 70. Door 70 is operatively connected by a shaft 72 to air cylinder 74 and extends therethrough. A plate 76 is affixed to the shaft 72, in a conventional manner, where it protrudes from air cylinder 74. A pair of tension springs 78 and 80 are connected to plate 76 urging it in a direction to maintain door 70 in a normally closed position. When air cylinder 74 is activated at the proper time in the rotary cycle, it acts against the tension provided by springs 78 and 80, thereby permitting door 70 to move away from the opening located in the bottom portion of receiving chute 68, thus permitting the work pieces 66 to flow into the discharge chute means 82.

Discharge chute 82 is curved and is provided at its far end with a second door or gate means 84, which is affixed to a shaft 86 in a conventional manner. The shaft 86 is operatively connected to air cylinder 88 and extends therethrough. A plate 90 is affixed to the portion of shaft 86 extending through the air cylinder 88, in a conventional manner. A pair of tension springs 92 and 94 are connected to plate 90 and provide tension thereto maintaining door 84 in a normally closed position at the far end of the discharge chute 82. When air cylinder 88 is activated, it reacts against the spring tension and opens discharge chute 82 permitting the work pieces to flow in the direction of arrows 96 into the discharge means 98. The gating assembly at the far end is similar in construction to the gating construction provided at the receiving end of discharge chute 82.

Discharge means 98 communicates with the furnace 12 and permits the work pieces 66 to flow therein as the rear plate section rotates in the direction of arrow 100. The discharge means 98 having an opening therein, which communicates directly with the furnace 12, permits the gases occurring internally therein to slowly leak back out into the discharge means. However, the door 84 does not permit any significant amount of gases to leak therethrough nor does door 70. Thus, although some small leakage occurs, very little if any contamination of the outside air is experienced by the atmosphere within the oven. A constant small flow of protective atmosphere is permitted to flow into an input valve 101, which is proximate door 84, from the furnace 12. The protective atmosphere provides a purging condition when doors 70 and 84 are closed and exits from output valve 102, which is proximate door 70, so that no outside air can enter with the work pieces 66 because only one door 84 or 70 is opened at any given time, as will be explained hereinafter.

In operation, the rear plate section 20 is caused to operate in the direction of arrow 100. As the rear plate section 20 rotates, the work pieces 66, stored in the hopper, will fall through to the rear side of plate 20 entering the J-shaped opening 34 and flow in the direction of arrow 96. As plate 20 continues to rotate, the work pieces 66 will fill the measuring station 40. At the proper point in the rotation of plate 20, air cylinder 54 will be activated by means, not shown, thereby permitting measuring station 40 to dump the contents therein into the receiving chute 68. After the contents of measuring station 40 are removed, cylinder 54 is deactivated and spring 50 returns it to its normal position. The cylinder 74 is then activated permitting the work pieces 66 to flow into the discharge chute 82. The work pieces 66 will continue to flow in the direction of arrows 96 as plate 20 is rotated. Shortly thereafter air cylinder 74 is deactivated permitting door 70 to close off receiving chute 68. The constant flow of purging protective atmosphere, via valves 101 and 102, prevents any outside air from remaining in the discharge chute 82 during this time. At a later time in the rotary cycle of plate 20 air cylinder 88 is activated permitting the work pieces 66 to flow into the retort or discharge means 98 which communicates with the mouth of the furnace 12. Air cylinder 88 is then deactivated closing off the far end of discharge chute 82 by means of the door 84. It is to be noted that the door 84 and the door 70 are never opened at the same time, therefore outside atmosphere is not permitted to flow into the furnace.

The advantage of using two doors, such as described above, over a system which uses one door or no doors, is to maintain a positive constant pressure within the rotating retort furnace while continuously feeding work into the retort. In this manner, the protective atmosphere and/or the additive gases, such as propane, ammonia, or natural gas are maintained at a constant concentration in the retort with the work, promoting improved uniformity in the quality of the heat treating process.

By utilizing the two-door system as described above, great amounts of gases used in the furnace may be saved. In order to maintain a measure of uniformity in the finished product large amounts of additive gases are required in order to overcome the leakage which would be present. The double-door feeder permits improved control of the furnace atmosphere by excluding the ingestion of large amounts of air with the work pieces and permits direct control of the furnace atmosphere with an automatic analyzing devising device such as infra-red analyzer and controller.

Hereinbefore has been disclosed a means for improving the product obtainable when using a volumetric feeder in association with a spiral rotary furnace. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. A volumetric feeder for a rotary furnace, comprising a measuring station; discharging means for discharging workpieces into the furnace; a discharge chute communicating with said measuring station and said discharging means; first gate means disposed at one end of said discharge chute proximate said measuring station and timed to open and receive workpieces at a particular point in a rotary cycle of the furnace; second gate means disposed at the other end of said discharge chute proximate said discharging means, said second gate means opening at another time in said rotary cycle of the furnace after said first gate means to permit workpieces to be discharged by gravity from said discharge chute into said discharging means; and purging means for purging outside air from said discharge chute, said purging means including supplying means communicating with said discharge chute proximate said discharging means for supplying a protective atmosphere to said discharge chute and exhausting means communicating with said discharge chute proximate said measuring station for exhausting outside air from said discharge chute in response to the supply of protective atmosphere to said discharge chute by said supplying means.

2. A volumetric feeder according to claim 1, wherein said supplying means is an inlet valve and said exhausting means is an outlet valve.

3. A volumetric feeder for a rotary furnace, comprising a measuring station including measuring means for measuring, in infinitely variable amounts, a quantity of workpieces in a batch being fed to the furnace, said measuring means including a housing having a plunger disposed therein, said plunger including a threaded shaft adjustably and threadably engaged with said housing so that the usable volume of said housing can be varied in response to rotation of said threaded shaft relative to said housing; discharging means for discharging workpieces into the furnace; a discharge chute communicating with said measuring station and said discharging means; first gate means disposed at one end of said discharge chute proximate said measuring station and timed to open and receive workpieces at a particular point in a rotary cycle of the furnace; and second gate means disposed at the other end of said discharge chute proximate said discharging means, said second gate means opening at another time in said rotary cycle of the furnace after said first gate means to permit workpieces to be discharged by gravity from said discharge chute into said discharging means.

4. A volumetric feeder for a rotary furnace, comprising discharging means for discharging workpieces into the furnace; a discharge chute communicating with said discharging means; a measuring station communicating with said discharge chute, said measuring station including measuring means rotatable towards and away from said discharge chute for measuring, in infinitely variable amounts, the quantity of workpieces in a batch being fed to the furnace and rotating means for rotating said measuring means towards and away from said discharge chute; first gate means disposed at one end of said discharge chute proximate said measuring station and timed to open and receive workpieces at a particular point in a rotary cycle of the furnace; and second gate means disposed at the other end of said discharge chute proximate said discharging means, said second gate means opening at another time in said rotary cycle of the furnace after said first gate means to permit workpieces to be discharged by gravity from said discharge chute into said discharging means.

5. A method of feeding batches of workpieces into a rotary furnace using a volumetric feeder which includes a hopper, a feed chute, a measuring station located adjacent to the feed chute, a discharge chute, discharging means for discharging workpieces into the furnace, first gate means adapted to selectively open and close and disposed in the discharge chute proximate the measuring station and second gate means adapted to selectively open and close and disposed in the discharge chute proximate the discharging means, comprising the steps of loading the hopper with workpieces; rotating the feeder so that the workpieces are collected in the feed chute; further rotating the feeder to cause the workpieces to fall from the feed chute into the measuring station under the influence of gravity, whereby the measuring station receives the workpieces; further rotating the feeder; opening the first gate as the workpieces are discharged from the measuring station to the discharge chute; closing the first gate means; purging outside air from the discharge chute by constantly supplying a protective atmosphere to the discharge chute, whereby any outside air trapped in the discharge chute is removed and replaced by the protective atmosphere; further rotating the feeder; opening the second gate means as the workpieces are discharged from the discharge chute to the discharging means; further rotating the feeder until the workpieces enter the furnace; and closing said second gate means.

* * * * *